United States Patent [19]

Fischer

[11] 4,290,360

[45] Sep. 22, 1981

[54] SELECTIVE INK AND WETTING LIQUID, OR WETTING LIQUID ONLY, APPLICATION SYSTEM FOR OFFSET PRINTING PRESSES

[75] Inventor: Hermann Fischer, Augsburg, Fed. Rep. of Germany

[73] Assignee: M.A.N.-Roland Druckmaschinen Aktiengesellschaft Offenbach, Augsburg, Fed. Rep. of Germany

[21] Appl. No.: 119,149

[22] Filed: Feb. 6, 1980

[30] Foreign Application Priority Data

Jan. 20, 1979 [DE] Fed. Rep. of Germany ..... 2902228

[51] Int. Cl.[3] ..... B41F 7/26; B41F 7/36; B41F 7/40

[52] U.S. Cl. ..... 101/148; 101/352

[58] Field of Search ..... 101/148, 147, 350, 351, 101/352, 247, 207, 208–210

[56] References Cited

U.S. PATENT DOCUMENTS

| | | | |
|---|---|---|---|
| 3,467,008 | 9/1969 | Domotor | 101/148 |
| 3,691,948 | 9/1972 | Southam et al. | 101/183 |
| 3,757,689 | 9/1973 | Koch | 101/148 |
| 3,791,294 | 2/1974 | Skelding et al. | 101/248 |
| 3,805,700 | 4/1974 | Chambon | 101/148 |
| 3,842,735 | 10/1974 | Southam et al. | 101/145 |
| 3,986,452 | 10/1976 | Dahlgren | 101/148 |

FOREIGN PATENT DOCUMENTS

| | | | |
|---|---|---|---|
| 2302261 | 7/1974 | Fed. Rep. of Germany | 101/148 |

*Primary Examiner*—J. Reed Fisher

*Attorney, Agent, or Firm*—Frishauf, Holtz, Goodman & Woodward

[57] ABSTRACT

To permit selective operation of an application roller either transferring wetting water and ink, or only wetting water, depending on subject matter to be printed on an offset printing machine, without disturbance of the ink distribution system thereof, the application roller is movably positioned to be, selectively, in engagement with an ink distribution roller or out of engagement therewith, the application roller being maintained in continuous engagement with the plate cylinder and a wetting liquid transfer roller being in continuous engagement with the application roller. Preferably, and to permit movement, engagement which includes the application roller is by a resilient bias force, for example supplied by a spring moving the water transfer roller towards the application roller, or the application roller itself against the plate cylinder.

11 Claims, 6 Drawing Figures

SELECTIVE INK AND WETTING LIQUID, OR WETTING LIQUID ONLY, APPLICATION SYSTEM FOR OFFSET PRINTING PRESSES

REFERENCE TO RELATED APPLICATIONS

U.S. Ser. No. 119,008, filed Feb. 6, 1980, LIEBERT,
U.S. Ser. No. 119,151, filed Feb. 6, 1980 LIEBERT,
all assigned to the assignee of the present invention.

The present invention relates to offset printing machines, and more particularly to rotary offset printing machines, which have an inking system and a wetting liquid fountain system where wetting liquid and ink can be applied together to the plate cylinder or, selectively, separately.

BACKGROUND AND PRIOR ART

It has previously been proposed—see German Patent Publication DE-AS No. 23 02 261—that the inking system applies ink over two roller trains to an ink application roller or to ink application rollers. One of the rollers of the ink train may, additionally, have wetting liquid applied thereto. Thus, this particular ink train will supply both ink as well as wetting liquid to the plate cylinder. Such an arrangement is suitable for numerous printing jobs, particularly if the subject does not tend to form ghosts, that is, if it is such that a large area of ink coverage is used. The possibility is retained to eliminate application of wetting liquid, typically water, by separating the water fountain system from the ink system by providing an intermediate roller, the position of the shaft of which can be changed. Upon such change-over, ink is applied only over the ink train to the plate cylinder, the other roller train being used exclusively to apply water to the plate cylinder. This arrangement can be used to good advantage to print subjects which tend to form ghosts, for example which have little printing ink content.

The arrangement has the disadvantage that, if ink and wetting liquid are to be applied separately to the plate cylinder, a portion of the roller train which is utilized to supply ink and to distribute ink thereover, is not used. This has the disadvantage that the ink which is being applied to the plate cylinder is not distributed sufficiently uniformly and is not applied in a layer which is sufficiently thin and at the same time uniform.

THE INVENTION

It is an object to improve the arrangement which permits selective application of ink-and-water in combined form, or separately, without interfering in the ink distribution system, which might have undesired effects on printing quality by eliminating portions of the ink train system.

Briefly, an additional application roller is provided which can, selectively, supply both ink and wetting liquid, or only wetting liquid, to the plate cylinder; this additional application roller is in continuous engagement with the wetting liquid fountain system and its rollers, and can be placed, selectively, in engagement with a distribution roller of the inking system so that the additional application roller either provides only the wetting liquid or, combined, the wetting liquid and ink. The ink train itself includes an ink application roller which applies ink independently of the additional roller to the plate cylinder. The additional application roller thus maintains continuous contact with the plate cylinder and the fountain system and can be selectively additionally contacted with the inking system.

DRAWINGS

Figure 2:
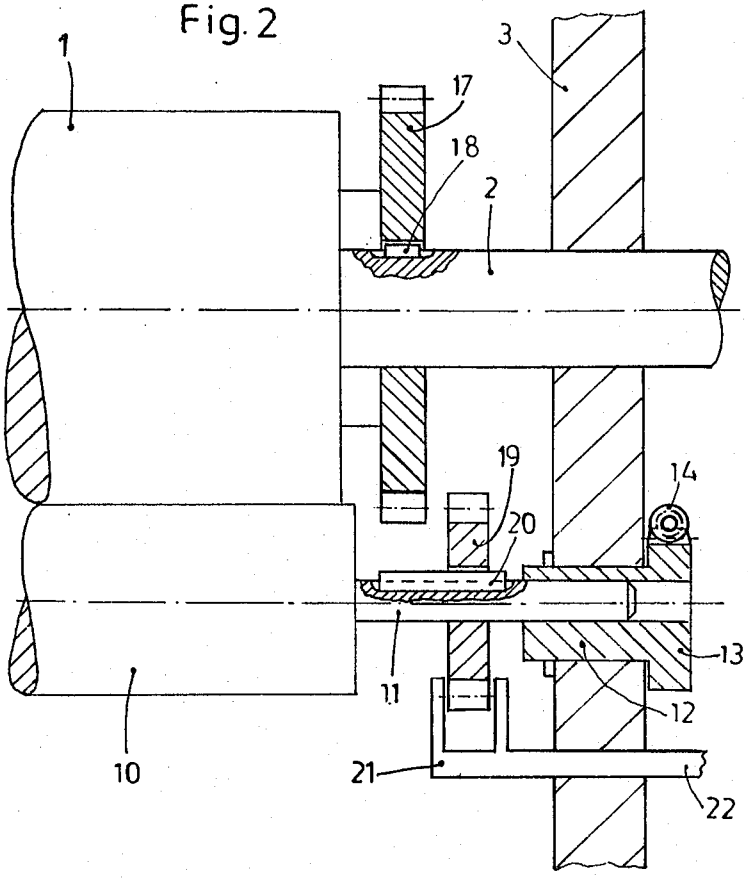
FIG. 2 is a sectional view along line II—II of FIG. 1.
Figure 4:
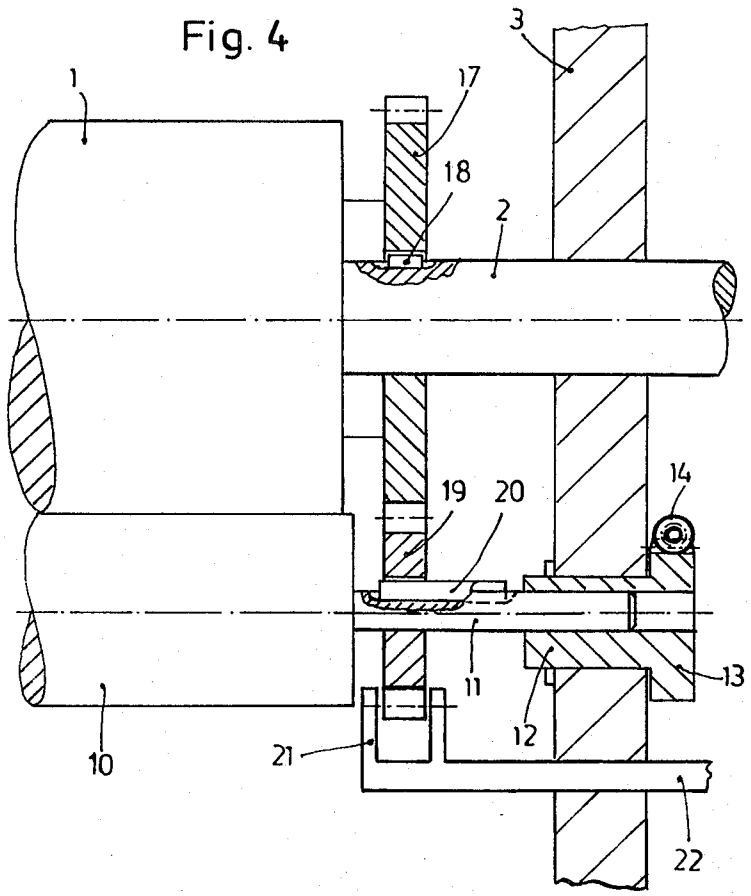
FIG. 4 is a section line along line IV—IV of FIG. 3.

A plate cylinder 1 (FIGS. 1–4) is supported by suitable bearings (not shown) journalling its shaft 2 in the end walls 3 of a printing machine; only one end wall is shown in FIGS. 2 and 4. The shaft 2 is driven in well known and any suitable manner by gears located within or beyond the side wall 3.

Wetting liquid, typically water, is supplied from a trough 4 in which a water pick-up roller 5 dips. The water pick-up roller 5 is driven at low speed and has a surface which is resilient and capable of accepting water. A water transfer roller 6 cooperates with the water pick-up roller 5. Transfer roller 6 has a metallic surface which is hydrophilic, that is, which can pick up, transfer and accept the wetting liquid. The water transfer roller 6 is journalled at its axial ends in a lever 7. Lever 7 is pivotably supported to pivot about the center 8 of the axis of the roller 5. Springs 9, secured to the frame of the machine, maintain the rollers in engagement and tend to pull them in the direction of the arrow a. The water transfer roller 6 is also driven by any well known suitable drive, and can also oscillate axially. Its circumferential speed is greater than that of the water pick-up roller 5.

Spring 9 tends to press the water transfer roller 6 against a further application roller 10. Application roller 10 has an elastic surface, for example of rubber. The further application roller 10 is secured on a shaft 11. Shaft 11, in turn, is located in an eccentric 12 which is positioned in the side walls 3. The eccentric 12 can be rotated either manually or, as shown, by machine power. To this end, the eccenter 12 has a spur gear 13 secured thereto which can be positioned by a worm 14. The worm can be operated manually or by remote control.

Ink is supplied by an inking system—not shown—and which can be of any standard well known suitable form. Preferably, the inking system has two ink trains. One ink train supplies ink to the plate cylinder over two ink application rollers in engagement therewith. This ink train can be of any standard or suitable construction; see, for example, the cross-referenced application Ser. No. 119,151, filed Feb. 6, 1980, Liebert. The other ink train terminates in an ink application roller 16 which is in engagement with a distribution roller 15. The distribution roller 15 is axially oscillating. It is driven with a surface speed which corresponds roughly to the surface speed of the plate cylinder. The distribution roller 15 has a metallic surface capable of accepting ink. The ink application roller 16 has an elastic surface, for example rubber, and is not driven.

A drive gear 17 is secured to the shaft 2 of the plate cylinder 1. The drive gear 17 is resiliently keyed to the shaft 2 by a spring key 18 which fits into a groove or notch formed both in the shaft 2 and in the gear 17. The gear 17 can be meshed with a drive gear 19 which is axially movable on the shaft 11 supporting the further application roller 10. The gear 19 and shaft 11 are keyed together by a resilient spring key 20. Engagement and disengagement between the gears 17, 19 is controlled by a claw 21 which fits around a portion of the gear 19 and which can be manually moved by handle 22 either out of engagement (FIG. 2) or in engagement (FIG. 4) with gear 17.

Figure 1:
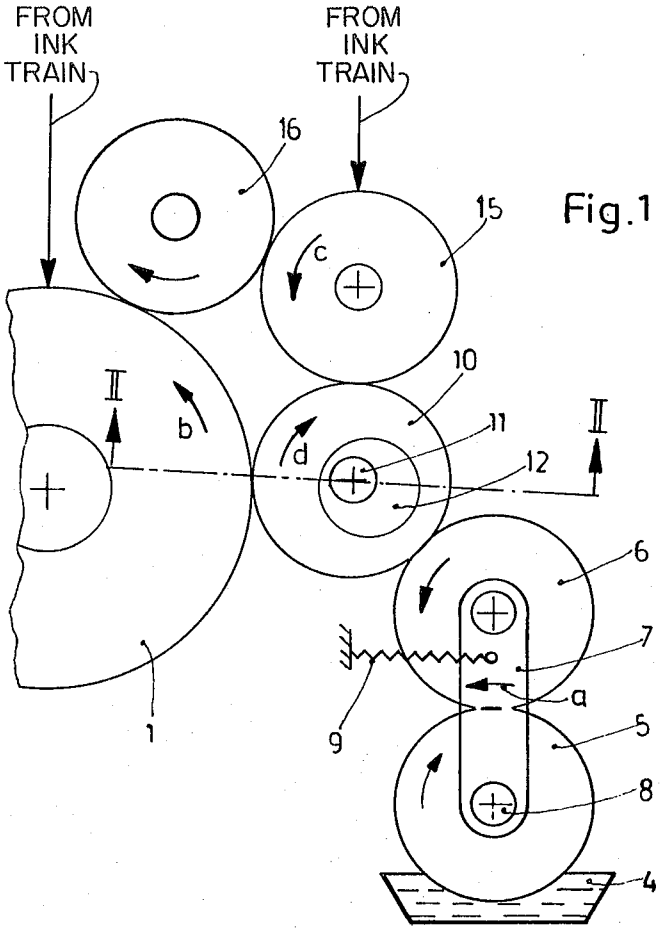
FIG. 1 is a highly schematic side view of the rollers of a rotary offset printing machine which are important for an understanding of the present invention in a first operating position.
Figure 3:
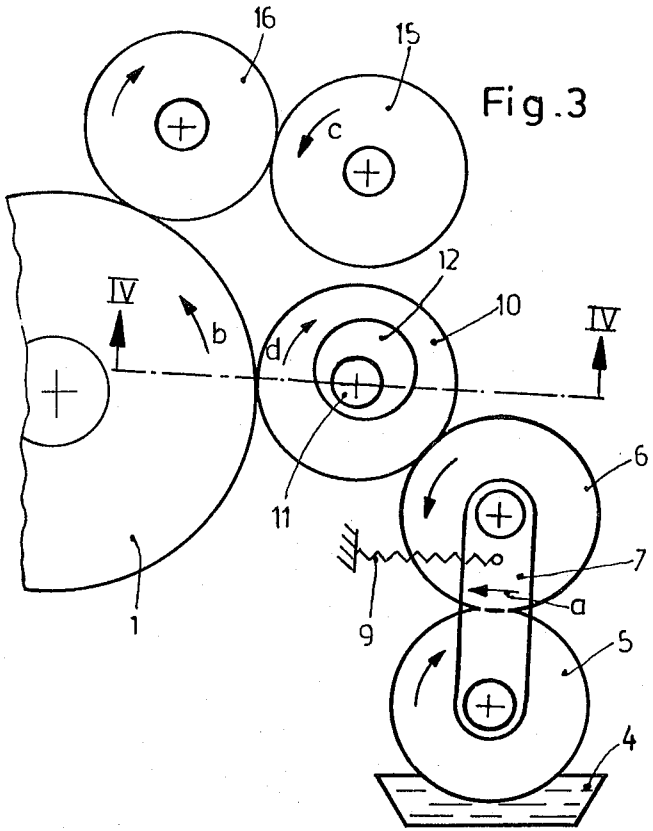
FIG. 3 is a view similar to FIG. 1 and illustrating the roller position upon change-over to a different operating position.

Operation, with particular reference to FIGS. 1 and 3: In a first operating position shown in FIGS. 1 and 2, the further application roller 10, which is a roller additional to the rollers 6 and 16, respectively, is in engagement with the plate cylinder 1 as well as with the ink distribution roller 15. If the plate cylinder 1 is driven in the direction of the arrow b, then ink distribution roller 15 will rotate in the direction of the arrow c with a surface speed which corresponds roughly to the surface speed of the plate cylinder 1. The further application roller 10 is positioned as shown, that is, with the eccentric 12 placing the center or shaft 11 of the roller 10 in engagement with the ink distribution roller 15; the distribution roller 15 will control the surface speed of the application roller 10. The surface of the distribution roller 15, of course, will have ink thereon. The surface of the water transfer roller 6, operating at a substantially lower speed, will have the wetting liquid applied thereto which, in contrast to the ink, is slippery. The application roller 10 thus will supply to the plate cylinder 1 not only the wetting liquid picked up from the water transfer roller 6 but also the ink received from the ink distribution roller 15.

If it is desired to operate with separate ink and wetting liquid supply, a second operating position is selected. The claw 21 (FIGS. 2, 4) is shifted to the left, into the position of FIG. 4, at which time the further application roller 10 will be driven from the plate cylinder by engagement of gear 17 and gear 19. The eccentric 12, likewise, is rotated to drop the center of the shaft 11 of the application roller 10, while maintaining engagement with the plate cylinder, but breaking engagement with the ink distribution roller 15. Thus, contact between the further application roller 10 and the plate cylinder 1 is maintained. The spring 9 ensures that the water transfer roller 6 continues in contact with the application roller 10.

Continued rotation of the plate cylinder 1 in the direction of the arrow b causes drive of the application roller 10 over the drive chain formed by gears 17, 19 in the direction of the arrow d. Preferably, the gears 17, 19 are so arranged that the application roller 10 rotates with a surface speed which differs by about 10% from the surface speed of the plate cylinder 1, for example by rotating faster or slower than the plate cylinder 1. This slight difference in speed has a cleaning effect and decreases slip between rollers.

Figure 6:
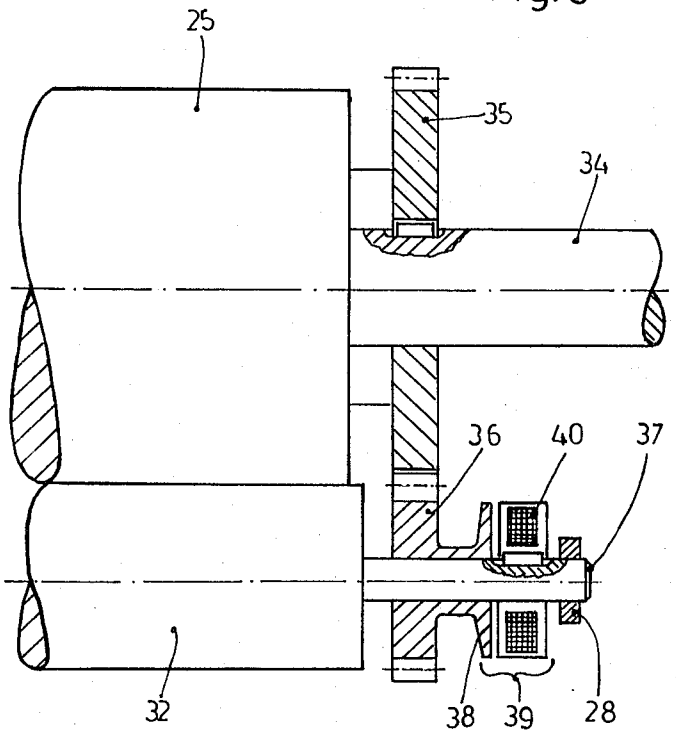
FIG. 6 is a sectional view along line VI—VI of FIG. 5.
Figure 5:
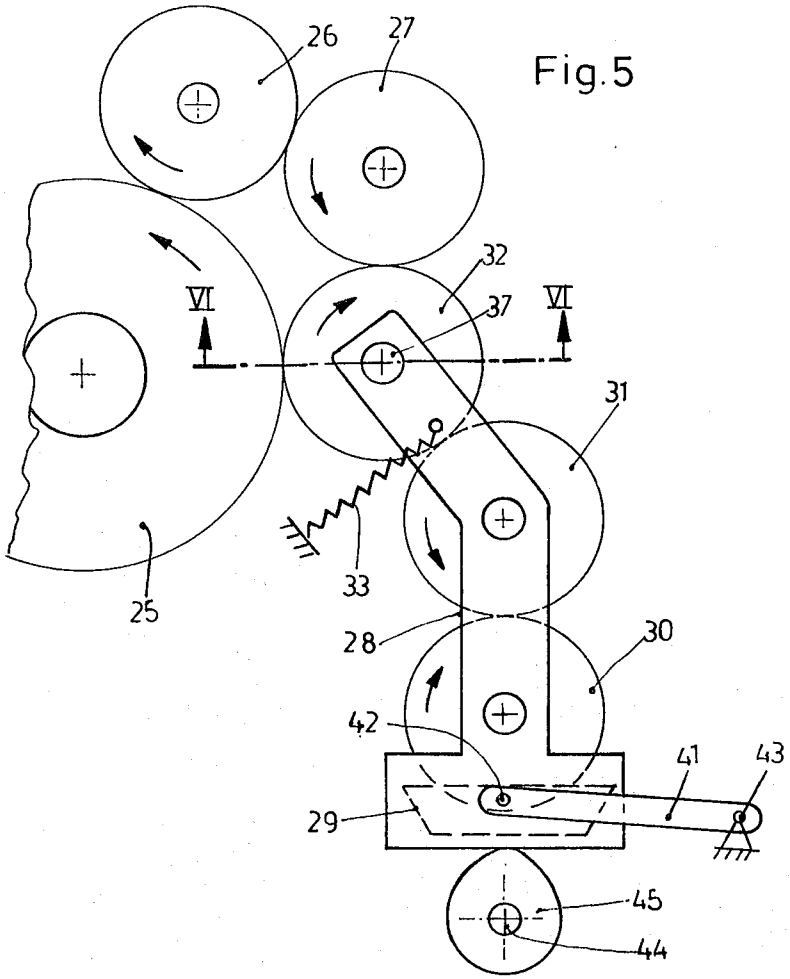
FIG. 5 is a schematic side view showing another embodiment of the roller arrangement.

Embodiment of FIGS. 5 and 6: The basic arrangement is similar to that of FIGS. 1–4; a plate cylinder 25 has ink applied thereto through a standard inking system—not shown—which has one ink roller train terminating in the ink application roller 26 in order to supply ink from the ink supply to the plate cylinder 25. The ink distribution roller 27 will have ink applied from the application roller 26. The distribution roller 27 is axially oscillating to provide for uniformity of ink film on the application roller 26.

The supply of wetting liquid is somewhat different; a trough 29 which holds wetting liquid is supported on a movable support 28. The support or carrier 28 can be selectively positioned by a cam 45 rotatable about a cam shaft 44. The support or carrier 28 supports a water pick-up roller 30, a water transfer roller 31 and the additional or further application roller 32. The water pick-up roller and the water transfer roller 31 are driven similarly to the rollers 5, 6 of FIGS. 1 and 3, that is, roller 30 is driven very slowly, roller 31 somewhat faster. The surfaces, likewise, are similar, that is, roller 30 has a soft, water-absorbent surface, and roller 31 is hydrophilic and metallic. A spring 33 is secured to the frame of the machine at one end and with the other applies a biassing force against the carrier 28. Another carrier, similar to carrier 28, is located at the other axial end of the machine.

Plate cylinder 25 is secured to a shaft 34 and suitably journalled in the side wall of the machine—not shown. A gear 35 is keyed to the shaft 34. The gear 35 is in continuous drive engagement with a gear 36 which can rotate freely on shaft 37 of the application roller 32. One half 38 of an electromagnetic clutch 39 is secured to the gear 38. The other half 40 of the electromagnetic clutch is secured or keyed to the shaft 37. Two guide levers 41 guide movement of the water trough 29. One end of the guide lever 41 is pivoted by pivot pins 42 to the water trough, the other end being pivoted at 43 to the frame of the machine. The carrier 28 and with it the water trough 29 rest on the cam 45.

Operation: FIG. 5 illustrates the system in the position in which the further application roller 32 provides to the plate cylinder 25 simultaneously ink and wetting liquid, that is, the application roller 32 is in engagement both with the ink distribution roller 27 and with the water transfer roller 31. In this position, the electromagnetic clutch 39 is de-energized, so that the surface speed of the further application roller 32 is determined by the surface speed of the ink distribution roller 27.

Change-over to provide, separately, ink and wetting liquid is effected by energizing the electromagnetic clutch 39, so that drive gear 35 will drive gear 36 and hence roller 32 when the plate cylinder 25 is being rotated. Additionally, the positioning shaft 44 which determines the position of the cam 45 is rotated by, for example, about 90°. This drops the carrier 28 so that the application roller 32 will be dropped off the ink distribution roller 27. Spring 33 ensures continued contact of the application roller 32 with plate cylinder 25. The guide lever 41 ensures at least approximate straight-line downward movement of the carrier 28. Water and ink will then be applied separately to the plate cylinder 25. Preferably, the gear chain 35, 36 is so arranged that the surface speed of the application roller 32 is by about 10% above or below the surface speed of the plate cylinder 25.

Various changes and modifications may be made, and features described in any one of the embodiments may be used with the other, within the scope of the inventive concept.

The centers of the shafts of the ink rollers 15, 16 or 26, 27, respectively, can remain fixed within the side walls of the machine. The position of the shaft 11 within the side wall can be changed by eccentric 12; the shaft 8 of the water pick-up roller 5 likewise can be fixed in the machine. The shaft of the water transfer roller 6 is movably supported by lever 7 as described in connection with FIGS. 1 and 3. In the embodiment of FIG. 5, the shafts of the rollers 30, 31 and 32 are all supported on the carrier 28 and can move therewith.

I claim:

1. In a rotary offset printing machine, apparatus to selectively in operation apply, together concurrently, or separately, printing ink and offset wetting liquid to the plate cylinder (1) thereof having an ink train including an ink distribution roller (15, 27) having ink supplied thereto;

an ink application roller (16, 26) in ink transmitting contact with the ink distribution roller (15, 27) and the plate cylinder (1);

and an offset wetting liquid fountain system (4, 5, 6; 29, 30, 31) including a wetting liquid transfer roller (6, 31);

comprising a further application roller (10, 32) in continuous engagement with the plate cylinder which, selectively, can apply to the plate cylinder ink and wetting liquid combined, or only offset wetting liquid, and means (12, 28) movably positioning the further application roller (10, 32), selectively, between a first operating positioning in which the further application roller is in engagement with the wetting liquid transfer roller (6, 31) and additionally in engagement with the ink distribution roller (15, 27) and a second operating position, in which the further application roller (10, 32) is in engagement with the wetting transfer roller and out of engagement with the ink distribution roller, the further application roller (10, 32) maintaining continuous contact, in either position, with the plate cylinder (1, 25) and with the offset wetting liquid transfer roller (6, 31) and the ink application roller maintaining continuous ink transmitting contact with the ink distribution roller (15, 27) and the plate cylinder (1).

2. Apparatus according to claim 1, wherein the wetting liquid transfer roller is a driven roller.

3. Apparatus according to claim 2, wherein the wetting liquid transfer roller (6, 31) is axially oscillating.

4. Apparatus according to claim 1, wherein the ink distribution roller (15, 27) is a driven, axially oscillating roller.

5. Apparatus according to claim 1, wherein (FIGS. 1–4) the means movably positioning the further application roller (10) comprises an eccentric (12), journalling a shaft (11) of the further application roller;

and resilient bias force means (9) are provided acting on the wetting liquid transfer roller (6) and maintaining surface contact engagement between the wetting liquid transfer roller (6) and the further application roller (10).

6. Apparatus according to claim 1, wherein (FIGS. 5, 6) a support (28) is provided journalling the further application roller (32) and the wetting liquid fountain system (29, 30, 31);

and selectively positionable cam means (45) are provided, supporting said support means (28) and selectively positionable to place the application roller (32) in surface contact engagement with the ink distribution roller (27) or out of engagement with the ink distribution roller (27) while maintaining contact, in either position, with the plate cylinder (25).

7. Apparatus according to claim 6, further comprising resilient force bias means (33) acting on the support (28) and biassing the position of the support (28) to maintain continuous resilient engagement between the further application roller (32) and the plate cylinder (25) in either position of the cam (45).

8. Apparatus according to claim 1, further comprising a drive gear train (17, 19; 35, 36) drivingly connecting the plate cylinder (1, 25) and the further application roller (10, 32);

and a selectively engageable clutch means (20, 21, 22; 39) selectively coupling and uncoupling engagement of said drive gear.

9. Apparatus according to claim 8, wherein said clutch means comprises claw means (21) engaging a gear (19) of the gear train (17) and permitting axial movement of the gear of the gear train in or out of engagement with a matching gear thereof.

10. Apparatus according to claim 8, wherein (FIGS. 5, 6) the clutch comprises an electromagnetic clutch (39) selectively effecting engagement of a gear of the gear train with the shaft on which it is mounted or loose rotation with respect thereto.

11. Apparatus according to claim 8, wherein the gear train ( 17, 19; 35, 36) between the plate cylinder (1, 35) and the further application roller (10, 32) provides for driven rotation of the further application roller at a circumferential speed which differs from that of the plate cylinder by up to about 10%.

* * * * *